US008506881B2

(12) United States Patent
Wittmer et al.

(10) Patent No.: US 8,506,881 B2
(45) Date of Patent: Aug. 13, 2013

(54) INTERMETALLIC BONDED DIAMOND COMPOSITE COMPOSITION AND METHODS OF FORMING ARTICLES FROM SAME

(75) Inventors: Dale E. Wittmer, Carbondale, IL (US); Peter Filip, Carbondale, IL (US)

(73) Assignee: Board of Trustees at the Southern Illinois University, Carbondale, IL (US)

( * ) Notice: Subject to any disclaimer, the term of this patent is extended or adjusted under 35 U.S.C. 154(b) by 313 days.

(21) Appl. No.: 11/389,546

(22) Filed: Mar. 24, 2006

(65) Prior Publication Data

US 2006/0280638 A1 Dec. 14, 2006

Related U.S. Application Data

(60) Provisional application No. 60/667,725, filed on Apr. 1, 2005.

(51) Int. Cl.
*C22C 33/02* (2006.01)

(52) U.S. Cl.
USPC ..... 419/11; 419/10

(58) Field of Classification Search
USPC ..... 428/403; 419/11, 10
See application file for complete search history.

(56) References Cited

U.S. PATENT DOCUMENTS

| | | | | |
|---|---|---|---|---|
| 3,293,012 A | | 12/1966 | Smiley et al. | |
| 3,458,144 A | | 7/1969 | Lessells et al. | |
| 4,919,718 A | | 4/1990 | Tiegs et al. | 75/232 |
| 4,985,051 A | * | 1/1991 | Ringwood | 51/309 |
| 5,330,701 A | * | 7/1994 | Shaw et al. | 419/10 |
| 5,608,911 A | | 3/1997 | Shaw et al. | |
| 5,905,937 A | | 5/1999 | Plucknett et al. | 419/12 |
| 6,372,346 B1 | | 4/2002 | Toth | 428/403 |

OTHER PUBLICATIONS

Acta Metal vol. 32 No. 10 pp. 2681-2688 (1989) Effect of Preoxidation and Grain Size on Ductility of a Boron-Doped $Ni_3AI$ AT Elevated Temperatures Authors: M. Takeyama and T. Liu.

Acta Metal vol. 36 No. 5 pp. 1241-1249 (1988) Effects of Grain Size and Test Temperature on Ductility and Fracture Behavoir of a B-Doped $Ni_3A1$ Alloy Authors: M. Takeyama and C. T. Liu.

International Search Report and Written Opinion Dated: Aug. 22, 2007 pp. 9.

* cited by examiner

*Primary Examiner* — Weiping Zhu

(57) ABSTRACT

An intermetallic bonded diamond composite composition and methods of processing such a composition are provided by the present invention. The intermetallic bonded diamond composite composition preferably comprises a nickel aluminide ($Ni_3Al$) binder and diamond particles dispersed within the nickel aluminide ($Ni_3Al$) binder. Additionally, the composite composition has a processing temperature of at least about 1,200° C. and is processed such that the diamond particles remain intact and are not converted to graphite or vaporized by the high-temperature process. Methods of forming the composite composition are also provided that generally comprise the steps of milling, pressing, and sintering the high-temperature intermetallic binder and diamond particles.

25 Claims, 4 Drawing Sheets

INTERMETALLIC BONDED DIAMOND COMPOSITE COMPOSITION AND METHODS OF FORMING ARTICLES FROM SAME

CROSS-REFERENCE TO RELATED APPLICATIONS

This application claims the benefit of U.S. Patent Application Ser. No. 60/667,725, filed Apr. 1, 2005, the entire disclosure of which is incorporated herein.

FIELD OF THE INVENTION

The present invention relates generally to wear resistant materials and more specifically to intermetallic bonded composite compositions and processes for forming articles from the same.

BACKGROUND OF THE INVENTION

In the field of wear resistant materials, diamonds are a desirable element due to their hardness and wear resistance. Known compositions having diamonds for wear resistance generally have resin or ductile metal binders with relatively low processing temperatures and pressures to achieve compaction and usable strength. The processing temperatures have been relatively low to prevent the diamonds from forming graphite or vaporizing during processing. If the diamonds form graphite, they lose their hardness and thus cannot be used in applications requiring wear resistance.

In the field of coal mining, for example, conventional tool bits have been made from tungsten carbide (WC) bonded with cobalt (Co), commonly referred to as carbides, for years because there has not yet to date been a material that can surpass WC in abrasion resistance. In operation, the attack of the Co binding phase leads to wear of the tool bit and as the WC bit wears, it becomes less efficient in cutting, produces more dust, and builds up heat at its tip. This heat in turn increases the attack on the binding phase and as a result, the tool tip either fractures or is pulled from the body of the cutting tool.

Additionally, most of the tungsten ore that is used to manufacture WC tool bits is exported from countries such as Canada, China, and Russia. Similarly, cobalt is also exported from countries such as China and South Africa. Thus, many countries are dependent on the importation of tungsten and cobalt for their industrial needs.

Although attempts have been made to embed diamonds into metals to improve wear resistance and sharpness of tools, these attempts have not been successful due to the poor oxidation resistance and poor thermal stability of the diamonds during processing of the metals. As previously stated, the diamonds also tend to form graphite and/or vaporize during processing, thus resulting in a material having unacceptable wear resistance.

SUMMARY OF THE INVENTION

In one preferred form, the present invention provides an intermetallic bonded diamond composite composition comprising a nickel aluminide ($Ni_3Al$) binder and diamond particles dispersed within the nickel aluminide ($Ni_3Al$) binder. The composite composition is processed at high-temperatures in a manner such that the diamond particles remain intact and do not form graphite or vaporize during processing.

In other forms, the intermetallic bonded diamond composite composition further comprising titanium carbide (TiC) for improved oxidation resistance, strength of the binder, diamond retention, and wear resistance. In yet another form, the intermetallic bonded diamond composite further comprises an additional alloying element selected from the group consisting of boron (B) and molybdenum (Mo) for increased ductility of the intermetallic.

The present invention also includes processes for forming an intermetallic bonded diamond composite. One process comprises the steps of milling an intermetallic binder and diamond particles, pressing the intermetallic binder and diamond particles to form a composite article, and sintering the composite article formed of the intermetallic binder and diamond particles at a processing temperature of at least about 1,200° C.

Additional forms of the present invention comprise a high-temperature intermetallic binder that has a variety of alloying elements in combination with the diamond particles. These alloying elements comprise nickel (Ni), aluminum (Al), chromium (Cr), iron (Fe), titanium (Ti), along with ceramic carbides. Additional alloying elements for affecting ductility are also provided in various forms of the present invention that comprise iron (Fe), titanium (Ti), zirconium (Zr), hafnium (Hf), vanadium (V), and chromium (Cr).

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying photomicrographs and drawings, wherein.

Corresponding reference numerals indicate corresponding parts throughout the several views of the drawings.

DETAILED DESCRIPTION OF THE PREFERRED EMBODIMENTS

The following description of the preferred embodiments is merely exemplary in nature and is in no way intended to limit the invention, its application, or uses.

The present invention generally comprises an intermetallic bonded diamond composite composition that is made of a high-temperature intermetallic binder and diamonds, hereinafter referred to as diamond particles. The high-temperature intermetallic binder is preferably nickel aluminide ($Ni_3Al$)

and may also include titanium carbide (TiC) to reduce oxidation, strength of the binder, diamond retention, and wear resistance, and either or both boron (B) and molybdenum (Mo) for increased ductility. However, nickel aluminide ($Ni_3Al$) alone, without the addition of titanium carbide (TiC), boron (B), or molybdenum (Mo) as the high-temperature binder has resulted in a composite composition having excellent wear resistance. Additional alloying elements that form a high-temperature intermetallic binder, other than or in addition to nickel aluminide ($Ni_3Al$), may also be employed in accordance with the teachings of the present invention as described in greater detail below.

Processing techniques according to various forms of the present invention are carried out at a relatively high temperature while preventing the diamond particles from forming graphite or vaporizing during processing. As a result, an intermetallic bonded diamond composite composition is used to form composite articles exhibiting superior wear resistance. These processes are described in greater detail below.

Figure 1:
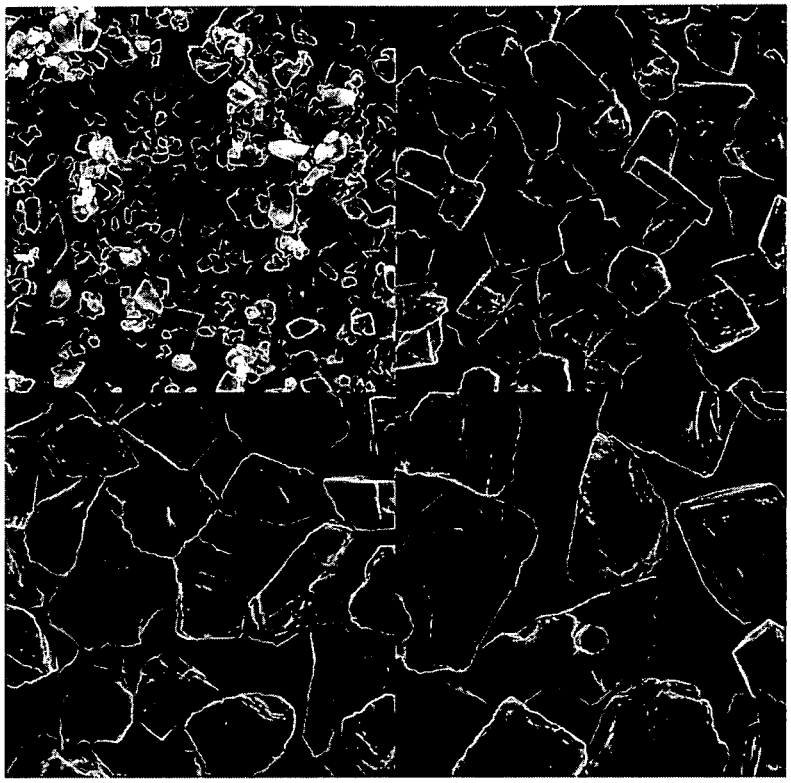
FIG. 1 is a series of photomicrographs at increasing magnification illustrating diamond particles of various sizes in accordance with the teachings of the present invention.

Referring to FIG. 1, a variety of diamond sizes were employed according to the teachings of the present invention. The sizes ranged from 2-10 μm (upper left), 10-15 μm (upper right), 35-40 μm (lower left), 20-25 μm (lower right), and sizes up to and including, but not limited to, 80-100 μm and 120-140 μm (not shown). Generally, larger diamond sizes are preferred because the smaller diamond sizes have demonstrated a reduced ability to withstand certain processing methods as described in greater detail below.

Figure 2:
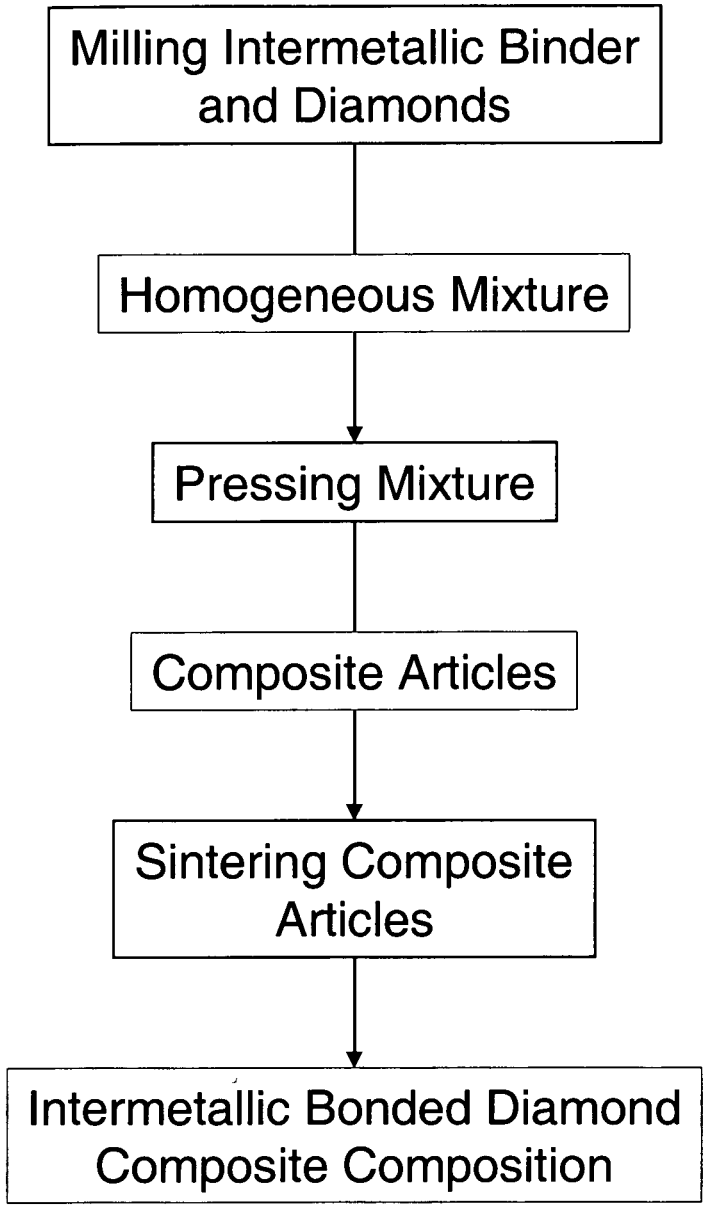
FIG. 2 is a process flow diagram illustrating a method of processing an intermetallic bonded diamond composite composition in accordance with the teachings of the present invention.

Referring now to FIG. 2, a method of processing the intermetallic bonded diamond composite composition is illustrated in a flow diagram. Generally, the high-temperature intermetallic binder and the diamond particles are milled to form a homogeneous mixture. The homogeneous mixture is then pressed to form a composite article in a shape as desired or as a coating on a substrate for the desired application, e.g. tool bit. The pressed composite article is then sintered by processes such as, but not limited to, continuous sintering, vacuum sintering, vacuum-pressure sintering, hot pressing, and hot isostatic pressing. This process, along with additional embodiments for further processing steps, are now described in greater detail.

Milling

The high-temperature intermetallic binder and the diamond particles are first milled preferably by a wet ball milling operation. Preferably, the fluid used for the wet milling is isopropyl alcohol; however, other fluids may also be used while remaining within the scope of the present invention. The high-temperature intermetallic binder and the diamond particles are placed in a container and milled for approximately two (2) hours in one form of the present invention. After the milling operation, the high-temperature intermetallic binder and the diamond particles form powders which are then dried, preferably in a vacuum oven, until all of the fluid is eliminated. In one form of the process according to the teachings of the present invention, the containers are periodically closed, shaken, and then returned to the dryer every thirty (30) minutes. After the fluid is eliminated, the high-temperature intermetallic binder and the diamond particles are preferably milled again for a period of time to deagglomerate the resulting powders.

After the milling operation, the powders are passed through a mesh sieve, e.g. 40 mesh, to obtain a free flowing powder mixture of the high-temperature intermetallic binder and diamond particles. The mixture is then pressed to form a composite article in a shape as desired or processed as a coating on a substrate for the desired end use or application.

Sintering

The composite articles formed from the intermetallic bonded diamond composite composition are then further developed through a sintering process. The sintering process may include one or more of a variety of sintering processes such as pressureless or continuous sintering, vacuum sintering, vacuum-pressure sintering, hot pressing, or hot isostatic pressing. These sintering processes are exemplary only and are not intended to limit the scope of the present invention. It should be understood that other sintering processes may also be employed while remaining within the teachings of the present invention.

With a pressureless or continuous sintering process, the composite articles are placed in graphite boats with tight fitting lids. Additionally, a setter plate, preferably coated with boron nitride (BN) to prevent reactions with the graphite, is used to protect the bottom of each boat. Preferably, boats containing no composite articles, or "dummy" boats, are placed before and after each boat containing composite articles for better thermal balance.

In one form, the boats are run on a belt at a rate into the furnace of the continuous sintering process until they are centered in a hot zone and are then stopped. The boats are held for a period of time, after which the temperature of the furnace is increased and the boats are held for an additional period of time. After this second hold period, the belt is started again and the boats are transported at a rate to complete the sintering process. In one form, the boats are run at a rate of about 1.5 in. (3.81 cm) per minute into a hot zone of approximately 2,192° F. (1,200° C.). The corresponding hold period is about one (1) hour and the temperature of the furnace is increased to about 2,552° F. (1,400° C.). The boats are then held for a period of about one (1) hour, after which the belt is started again and moved at a rate of about 1.5 in. (3.81 cm) per minute to complete processing of the composite articles.

In an alternate vacuum/pressure sintering process, similar graphite boats containing the composite articles are centered in a large tube furnace. After purging the furnace, preferably with argon (Ar), the temperature is increased from room temperature under vacuum at a given rate to a first temperature. At this first temperature, the furnace is again purged and the temperature is increased again for a period of time to a second temperature. The temperature is again increased to a third temperature and pressure is increased to a given level and held for a period of time. The furnace power is then shut off and the graphite boats and the composite articles contained therein are allowed to cool to room temperature.

In one form, the furnace is first purged with Ar for three (3) cycles and the first temperature is about 1,832° F. (1,000° C.), which is obtained at a rate of about 50° F. (10° C.) per minute. The second temperature is about 2,192° F. (1,200° C.) and the first hold time is about one (1) hour. The third temperature is about 2,507° F. (1,375° C.) with a pressure of about 300 psig of Ar for a period of time of about one (1) hour.

In an alternate hot pressing process, dies and punches are preferably formed from high density graphites, although the high density graphites exhibit a tendency to wear. The composite articles are first preloaded and then the hot press is purged through a number of cycles, preferably using Ar. Vacuum is then applied and held for a period of time, after which the temperature is increased to a first level, stabilized for a period of time, and then increased to a second level. Pressure is then increased and the temperature increased again to a third level, while the load is increased to a given level. The temperature is held at this third level for a period of time and the temperature is further increased along with pressure until a predetermined extension or temperature maximum is reached.

In one form, the preload is about 500 lbs and the hot press is purged for three (3) cycles. The vacuum is held for about 8 to 12 hours and the first temperature is about 932° F. (500° C.). The second temperature is about 1,832° F. (1,000° C.), followed by a pressure of about 5 psi of Ar and a third temperature of about 2,192° F. (1,200° C.) under about a load of about 1,500 lbs. The third temperature was held for about one (1) hour, and the temperature maximum or peak, which varies according to the intermetallic bonded diamond composite composition, is established as the temperature just below where the intermetallic is forced out of the hot-press die at a load of about 1,500 lbs.

Generally, the hot press process results in higher density compacts, as the pressure from this process forces the liquid intermetallic into the pores of the composite composition and forces out trapped gasses. Additionally, preferably processing temperatures for the sintering processes described herein are between about 2,192° F. (1,200° C.) and about 2,912° F. (1,600° C.) for times between about 15 minutes and about 2 hours or more.

Figure 3:
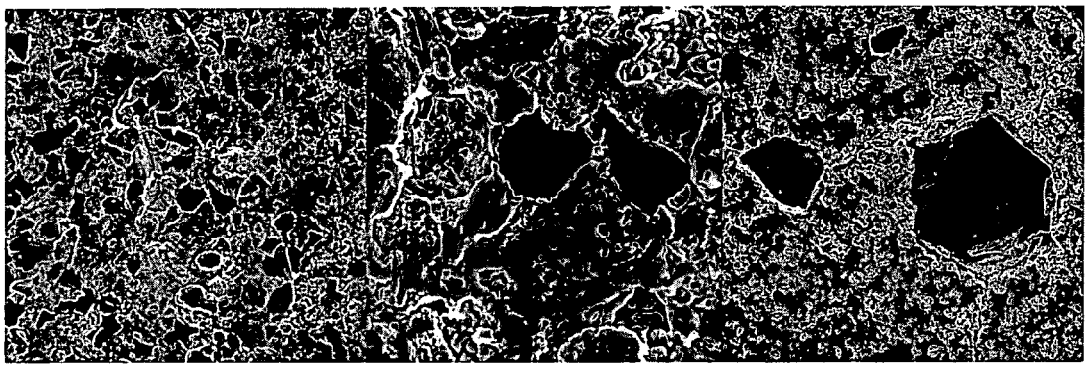
FIG. 3 is a series of photomicrographs at increasing magnification illustrating diamond particles within an intermetallic composite binder after high-temperature processing in accordance with the teachings of the present invention.
Figure 4:
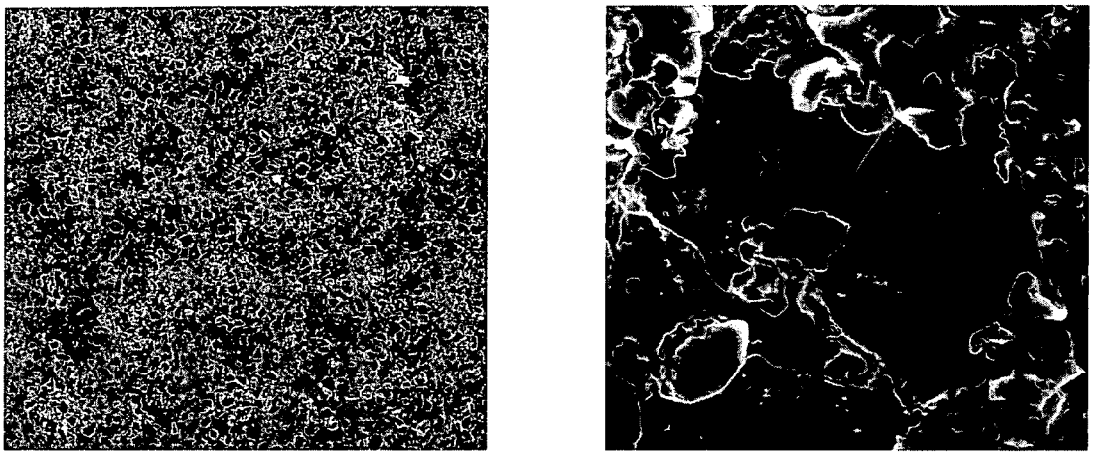
FIG. 4 is a series of photomicrographs at increasing magnification illustrating faceted diamond particles within an intermetallic composite binder after high-temperature processing in accordance with the teachings of the present invention.

Referring now to FIGS. 3 and 4, the presence of diamonds in the high-temperature intermetallic binder after processing is shown. FIG. 3 illustrates scanning electron microscope (SEM) images of intermetallic bonded diamonds (IBDs) following continuous sintering at 1,400° C. FIG. 4 illustrates SEM images of a hot-pressed surface of an intermetallic bonded diamond formulation showing how well dispersed and faceted the diamonds are after processing. The diamonds, which are the dark phase, are well preserved and well faceted, and have not been converted to graphite or vaporized during processing. These photomicrographs are of an intermetallic bonded diamond composite composition having only nickel aluminide ($Ni_3Al$) as the high-temperature intermetallic binder without any additional alloying element, thus demonstrating that this intermetallic binder alone protects the diamonds from graphitization and vaporization.

The formulation for the high-temperature intermetallic binder is preferably a nickel aluminide ($Ni_3Al$) with additional alloying elements in other forms of the invention to improve properties of the intermetallic bonded diamond composite composition. For example, titanium carbide (TiC) is added to reduce oxidation, improve strength of the binder, improve diamond retention, and increase wear resistance of the composite composition. Additionally, boron (B) and/or molybdenum (Mo) are added to improve the ductility of the composite composition. Other elements such as iron (Fe), titanium (Ti), zirconium (Zr), hafnium (Hf), vanadium (V), or chromium (Cr) may also be employed to improve the ductility of the composite composition in accordance with the teachings of the present invention.

Alternately, the high-temperature intermetallic binder may be composed of combinations of nickel (Ni), aluminum (Al), chromium (Cr), iron (Fe), and titanium (Ti) while remaining within the scope of the present invention. Additionally, the high-temperature intermetallic binder may also comprise a ceramic carbide such as, by way of example, titanium carbide (TiC), silicon carbide (SiC), tungsten carbide (WC), or boron carbide ($B_4C$).

According to the principles of the present invention, it has been determined that at least one mechanism for the protection of the diamonds during high-temperature processing is the relative close proximity, or high difference, of the coefficient of thermal expansion (CTE) of the diamond particles and the high-temperature intermetallic binder. For instance, the CTE of the diamond particles is approximately $1.0\times10^{-6}$/° C. and the CTE of the high-temperature intermetallic binder of $Ni_3Al$ is approximately $14.0\times10^{-6}$/° C. The large difference in these CTE values provides for the contraction of the intermetallic binder surrounding the diamond particles, thus physically clamping the diamonds through the compressive stresses developed. These clamping stresses are believed to put enough stress on the diamond particles to keep them from converting to graphite. Accordingly, other materials having relatively large differences in CTE compared to that of the diamond particles may also be employed as a binder in accordance with the teachings of the present invention.

The diamond volume is generally between about 0.5% by volume to about 80% by volume, although higher values may also be employed depending on the high-temperature intermetallic binder and the particular end use or application. Sizes of the diamond particles range from about 1 micron up to about 700 microns or even greater, depending again on the high-temperature intermetallic binder and the particular application.

Applications for such an intermetallic bonded diamond composite composition are numerous and include, by way of example, coal mining tools, rock bits, rock cutters, masonry cutter and drills, cutting tools, abrasion resistant parts, rotary cutters, industrial drills, continuous miners, particle board cutters, ceramic tile cutters and routers, and high heat transfer platens and shapes. It should be understood that these applications are exemplary only and should not be construed to limit the scope of the present invention.

In testing conducted to date, the intermetallic bonded diamond composite compositions have been shown to improve wear resistance up to 800 times that of conventional tungsten carbide (WC). Table I below illustrates results of such testing, which includes both grinding and diamond cut-off wheel testing, with various formulations of intermetallic bonded diamond composite compositions compared with tungsten carbide (WC).

TABLE I

| Sample | Diamond Wt. % | Formulation | Wt. Loss (grinding) | Ave. Depth of Cut (in.) | Area of Cut ($in^2$) | Penetration Rate × $10^{-3}$ ($in^2$/min) |
|---|---|---|---|---|---|---|
| IBD1 | 33 | $Ni_3Al$ | 5.6% | 0.489 | 0.134 | 4.5 |
| IBD2 | 35 | $Ni_3Al$ and 35% TiC | 5.0% | 0.150 | 0.041 | 1.4 |
| IBD3 | 33 | $Ni_3Al$ | 1.7% | 0.036 | 0.008 | 0.3 |
| IBD4 | 35 | $Ni_3Al$ and 35% TiC, B, and Mo | 1.9% | 0.034 | 0.009 | 0.3 |
| WC | None | 94% WC and 6% Co | 3.7% | 0.912 | 0.324 | 259.2 |

Additional testing including polishing the composite articles using standard metallographic techniques resulted in extremely high wear resistance. In one set of tests, after 30 hours of polishing against a new 250 μm diamond polishing wheel, less than 1% wear was observed. It should be understood that these test results are exemplary in nature to demonstrate the improved wear resistance of intermetallic bonded diamond composite compositions over conventional tungsten carbide (WC) and in no way are intended to limit the scope of the present invention.

The description of the invention is merely exemplary in nature and, thus, variations that do not depart from the substance of the invention are intended to be within the scope of the invention. Such variations are not to be regarded as a departure from the spirit and scope of the invention.

What is claimed is:

1. An intermetallic bonded diamond composite composition comprising a nickel aluminide ($Ni_3Al$) binder and diamond particles which are dispersed within the nickel aluminide (Ni3Al) binder, wherein the diamond particles consist of a size greater than 10 microns up to about 700 microns.

2. The intermetallic bonded diamond composite composition according to claim 1, wherein the diamond particles comprise between approximately 33% and approximately 35% by weight of the composition.

3. The intermetallic bonded diamond composite composition according to claim 1, wherein the diamond particles comprise between approximately 20% and approximately 70% by weight of the composition.

4. The intermetallic bonded diamond composite composition according to claim 1, wherein the diamond particles are between approximately 10 and approximately 140 microns in size.

5. The intermetallic bonded diamond composite composition according to claim 1 further comprising titanium carbide (TiC).

6. The intermetallic bonded diamond composite composition according to claim 1 further comprising additional alloying elements selected from the group consisting of boron (B), molybdenum (Mo), iron (Fe), titanium (Ti), zirconium (Zr), hafnium (Hf), vanadium (V), or chromium (Cr).

7. The intermetallic bonded diamond composite composition according to claim 1 incorporated into a mining tool.

8. The intermetallic bonded diamond composite composition according to claim 7 wherein the mining tool is a rock bit.

9. The intermetallic bonded diamond composite composition according to claim 7 wherein the mining tool is a rock cutter.

10. The intermetallic bonded diamond composite composition according to claim 1 incorporated into a cutting tool.

11. The intermetallic bonded diamond composite composition according to claim 1 incorporated into a drill.

12. The intermetallic bonded diamond composite composition according to claim 1 incorporated into an abrasion resistant part.

13. The intermetallic bonded diamond composite composition according to claim 1 incorporated into a tile cutter.

14. The intermetallic bonded composite composition of claim 1 wherein the diamond volume is between about 0.5% and about 50% by volume of the composition.

15. An intermetallic bonded diamond composite composition comprising a high-temperature intermetallic binder and diamond particles dispersed within the high-temperature intermetallic binder, wherein the high-temperature intermetallic binder has a processing temperature of at least about 1,200° C., and a coefficient of thermal expansion that is substantially different from the coefficient of thermal expansion for the diamond particles, which provides for contraction of the binder surrounding the diamond particles, and wherein the diamond particles consist of intact diamond particles having a size greater than 10 microns up to about 700 microns.

16. The intermetallic bonded composite composition according to claim 15, wherein the high-temperature intermetallic binder comprises nickel aluminide ($Ni_3Al$) and at least one alloying element selected from the group consisting of boron (B), molybdenum (Mo), iron (Fe), titanium (Ti), nickel (Ni), aluminum (Al), chromium (Cr), and combinations thereof.

17. The intermetallic bonded composite composition according to claim 16, wherein the high-temperature intermetallic binder further comprises a ceramic carbide.

18. The intermetallic bonded composite composition according to claim 17, wherein the ceramic carbide is selected from a group consisting of titanium carbide (TiC), silicon carbide (SiC), tungsten carbide (WC), and boron carbide ($B_4C$).

19. The intermetallic bonded diamond composite composition according to claim 15, wherein the high-temperature intermetallic binder further comprises additional alloying elements selected from the group consisting of zirconium (Zr), hafnium (Hf), vanadium (V), and chromium (Cr).

20. The intermetallic bonded composite composition according to claim 15 wherein the high-temperature intermetallic binder further comprises tungsten (W).

21. The intermetallic bonded diamond composite composition according to claim 15, wherein the diamond particles comprise between approximately 20% and approximately 70% by weight of the composition.

22. The intermetallic bonded diamond composite composition according to claim 15, wherein the diamond particles range between approximately 10 and approximately 140 microns in size.

23. An intermetallic bonded diamond composite comprising a high-temperature intermetallic binder and diamond particles consisting of intact diamond particles having a size greater than 10 microns up to about 700 microns, the composite formed by a process of:

milling the high-temperature intermetallic binder and diamond particles, pressing the high-temperature intermetallic binder and diamond particles, and sintering the high-temperature intermetallic binder and diamond particles to form the intermetallic-bonded diamond composite, wherein the high-temperature intermetallic binder has a processing temperature of at least about 1,200° C., and has a coefficient of thermal expansion that is substantially different from the coefficient of thermal expansion of the diamond particles, which provides for contraction of the binder surrounding the diamond particles.

24. An intermetallic bonded diamond composite comprising diamond particles consisting of intact diamond particles having a size greater than 10 microns up to about 700 microns, disposed within a nickel aluminide ($Ni_3Al$) binder, the diamond particles and the binder each defining a coefficient of thermal expansion, wherein the nickel aluminide ($Ni_3Al$) binder has coefficient of thermal expansion that is substantially different from the coefficient of thermal expansion of the diamond particles, which provides for contraction of the binder surrounding the diamond particles.

25. An intermetallic composite composition comprising diamond particles consisting of a size greater than 10 microns up to about 700 microns, the intermetallic composite composition being formed using a high-temperature intermetallic binder having a coefficient of thermal expansion that is substantially greater than the coefficient of thermal expansion of the diamond particles, by a high-temperature process having temperatures of at least about 1,200° C., wherein the substantially greater coefficient of thermal expansion of the binder provides for contraction of the binder surrounding the diamond particles, such that the diamond particles remain intact and are not converted to graphite or vaporized by the high-temperature process.

* * * * *